US009347263B2

(12) United States Patent
Weston

(10) Patent No.: US 9,347,263 B2
(45) Date of Patent: May 24, 2016

(54) COLLAPSIBLE LADDER

(71) Applicant: TELETOWER.COM LIMITED, Woodford Green, Essex (GB)

(72) Inventor: Richard Weston, Halstead (GB)

(73) Assignee: TELETOWER.COM LIMITED, Woodford Green, Essex (GB)

( * ) Notice: Subject to any disclaimer, the term of this patent is extended or adjusted under 35 U.S.C. 154(b) by 0 days.

(21) Appl. No.: 14/413,173

(22) PCT Filed: Jul. 2, 2013

(86) PCT No.: PCT/IB2013/055428
§ 371 (c)(1),
(2) Date: Jan. 6, 2015

(87) PCT Pub. No.: WO2014/006568
PCT Pub. Date: Jan. 9, 2014

(65) Prior Publication Data

US 2015/0204138 A1 Jul. 23, 2015

(30) Foreign Application Priority Data

Jul. 6, 2012 (GB) ..... 1212092.9

(51) Int. Cl.

| | |
|---|---|
| ***E06C 1/22*** | (2006.01) |
| ***E06C 1/12*** | (2006.01) |
| ***E06C 7/42*** | (2006.01) |
| ***E06C 7/50*** | (2006.01) |

(52) U.S. Cl.
CPC . *E06C 1/22* (2013.01); *E06C 1/125* (2013.01); *E06C 7/42* (2013.01); *E06C 7/50* (2013.01)

(58) Field of Classification Search
CPC ..... E06C 1/12; E06C 1/125; E06C 1/22; E06C 7/42; E06C 7/423; E04F 11/06; E04F 11/068
See application file for complete search history.

(56) References Cited

U.S. PATENT DOCUMENTS

| | | | | |
|---|---|---|---|---|
| 3,933,221 | A * | 1/1976 | Sorenson | 182/172 |
| 4,744,471 | A * | 5/1988 | Leister | 211/7 |
| 5,590,739 | A * | 1/1997 | High et al. | 182/169 |
| 5,645,140 | A * | 7/1997 | Mouneimneh | 182/195 |
| 5,857,544 | A * | 1/1999 | Del Sole | 182/180.3 |
| 8,365,865 | B2 * | 2/2013 | Moss et al. | 182/172 |
| 2010/0071996 | A1 * | 3/2010 | Huang | 182/118 |

FOREIGN PATENT DOCUMENTS

| | | |
|---|---|---|
| CN | 202360017 | 8/2012 |
| DE | 8713518 | 1/1988 |
| JP | 2004131971 | 4/2004 |

OTHER PUBLICATIONS

International Searching Authority; PCT International Search Report; entire document.

* cited by examiner

*Primary Examiner* — Charles A Fox
*Assistant Examiner* — Kristine Florio
(74) *Attorney, Agent, or Firm* — Allen Dyer Doppelt Milbrath & Gilchrist

(57) ABSTRACT

An extendable ladder having a collapsed mode and an extended mode, characterized in that when the ladder is transformed from the collapsed mode to the extended mode, at least one ground stabilizer extends laterally from the ladder to widen the footprint of the ladder.

6 Claims, 1 Drawing Sheet

COLLAPSIBLE LADDER

CROSS-REFERENCE TO RELATED APPLICATIONS

This application is the §371 National Stage Entry of International Application PCT/IB2013/055428, filed on Jul. 2, 2013, which claims the benefit of United Kingdom Patent Application Serial No. GB 1212092.9, filed on Jul. 6, 2012, the contents of which applications are herein incorporated by reference in their entirety.

FIELD OF THE INVENTION

This invention relates to collapsible ladders and more specifically to increasing the stability of a extendible ladders when erected.

BACKGROUND OF THE INVENTION

Collapsible ladders are utilised because of the convenience they provide. They may be transported easily, such as in the trunk of a car, and may be carried and erected by one man. It is beneficial for such ladders to collapse to the smallest possible size, whilst still allowing them to be erected to a useful height.

Reducing the physical dimensions to produce the smallest collapsed size has the downside of reducing the width of the footprint when the ladder is erected. A narrower footprint reduces the stability of the ladder, the degree of instability being more noticable the taller the ladder.

Previous solutions to this include the provision of removable feet located at the bottom of each stile which serve to widen the foot print of the ladder, but these are cumbersome to attach or remove each time the ladder is collapsed or erected for transport.

SUMMARY OF THE INVENTION

With a view to mitigating the foregoing disadvantage, the present invention provides an improved extendable ladder. According to an embodiment of the present invention, an extendable ladder has a collapsed mode and an extended mode. When the ladder is transformed from the collapsed mode to the extended mode, at least one ground stabiliser extends laterally from the ladder to widen the footprint of the ladder.

Preferably, the stiles of the ladder may extend telescopically.

The at least one one ground stabiliser may be urged laterally outwards by a spring.

The at least one ground stabiliser may be retained in a retracted position by a pin engaged within a hole when the ladder is in a collapsed mode.

The pin may be resiliently biased towards the hole in the ground stabiliser.

The pin may be supported by one of the telescopic stiles of the ladder such that when the stiles slide relative to one another as the ladder is extended the pin is pulled out of the hole, releasing the ground stabiliser.

Preferably, at least two ground stabilisers may extend coaxially from each of the two stiles of the ladder.

The two ground stabilisers may extend from a hollow floor rung and are biased apart by a spring contained within the rung.

Preferably the motion of the ground stabiliser is damped.

Alternatively a podium may be provided comprising a rectangular platform and a ladder as described above, hingedly attached to each of two opposing sides of the platform.

BRIEF DESCRIPTION OF THE DRAWINGS

The invention will now be described further by way of example with reference to the accompanying drawings in which.

DETAILED DESCRIPTION OF PREFERRED EMBODIMENTS

Figure 1:
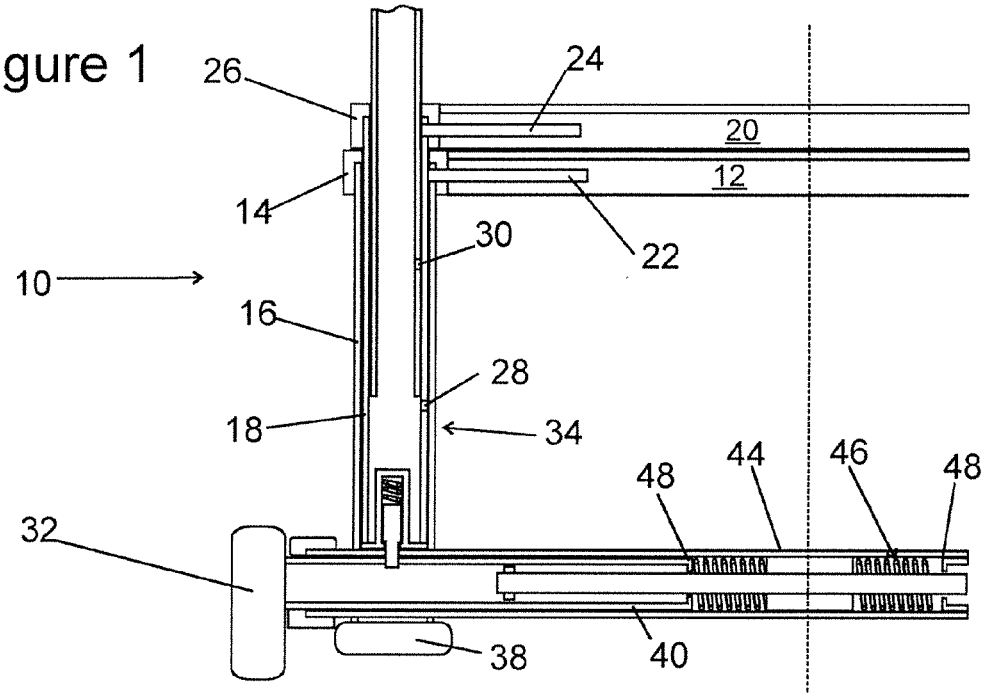
FIG. 1 shows a sectional view of the lower most rung of a collapsed ladder embodying the present invention, with its ground stabilsers in a retracted position.

Turning now to FIG. 1, a collapsible ladder embodying the present invention is shown. In this example a telescopic ladder 10 is of the type described in U.S. Pat. No. 5,495,915. The dotted line to the right of the figures represents a vertical line of symmetry. The description provided here should be assumed to be duplicated about this line.

The ladder is formed of individual rungs 12, 20 having two ends (one end 14 of each rung shown). Each end 14 is connected to and associated with a corresponding hollow stile section 16. The stile sections 16 associated with a first rung 12 are larger in diameter than the stile sections 18 associated with a second rung 20 immediately above. As a result, the ladder 10 may be collapsed by sliding the stile sections 16,18 inside one another resulting in the collapsed ladder having rungs 12,20 which rest directly on top of one another.

To extend the ladder the rungs 12,20 are separated causing the stile sections 16,18 to slide telescopically apart. They continue to slide until a spring biased pin 22,24 arranged inside the ends 14,26 of each rung 12,20 engages with a hole 28,30 in the circumference of the stile section of the rung immediately above.

The spring biased pins 22,24 lock the stile sections 16,18 at the separation predetermined by the position of the holes 28,30. Typically the rungs are separated starting with the bottom two rungs 12,20 and then working up the ladder 10 towards its top. This allows the height of the ladder to be chosen depending on the extension required.

As stability is increased by widening the foot print of the ladder, or increasing the distance between the outermost points of the foot of the ladder, the present invention is provided with extendable feet or ground stabilisers 32.

These protrude at the outer circumference of the stiles 34 of the ladder where they meet the floor 36. The stiles 32 are each provided with a curved high grip rubber foot 38 inserted into the hollow stile 32 to provide a better purchase on the ground 36 regardless of the angle of the ladder 10. These feet define the width of the foot print of a standard ladder.

Figure 2:
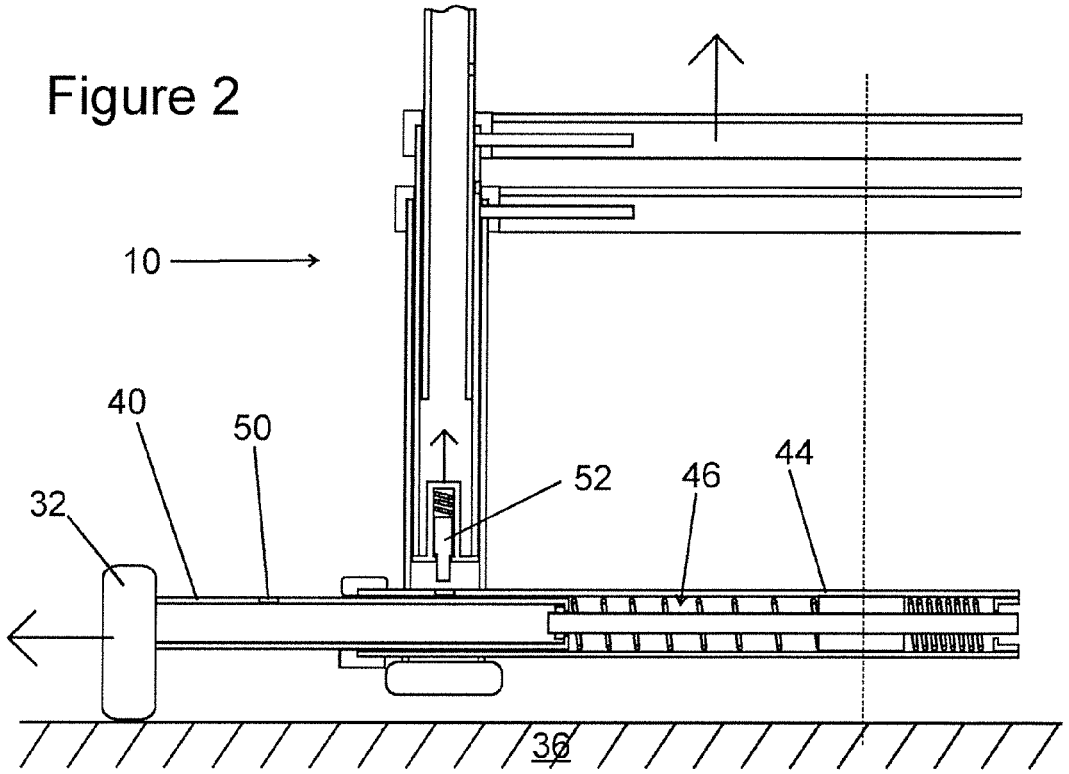
FIG. 2 shows a sectional view of the lower most rung of a partially extended extended ladder embodying the present invention, with its ground stabilsers in an extended position.

In the present invention, the ground stabilisers 32 may themselves be in either a retracted (FIG. 1) or extended (FIG. 2) position. In the retracted position, the ground stabilisers of the preferred embodiment increase the width of the foot print of ladder in the preferred embodiment, when compared to a ladder not so equipped. In some applications this may be undesirable and so is considered optional.

In an alternative embodiment, the ground stabilisers 32 may be integral to the outer circumference of the stiles 34 immediately adjacent the ground 36 such that when retracted the ground stabilisers 32 sit flush with the circumference of the largest diameter stile portion at the foot of the ladder.

For ease of transportation, the ground stabilisers 32 are best maintained in the retracted position as shown in FIG. 1. The stabilisers each consist of a cylindrical support tube 40 supported for axial movement within a transverse aperture 42 in the lowermost stile section 16. In an alternative embdiment, the stabiliser 32 may be supported within a plastic attachment including a foot portion to be attached the bottom of each stile 34. In this preferred embodiment, the apertures for supporting each tube 40 of each ground stabiliser are coaxial and joined by a hollow ground tube 44.

The stabilisers 32 are urged outwards by means of a resilient member 46 such as a spring acting between the inner most ends 48 of both ground stabilisers 32. The resilient member 46 is retained within the hollow ground tube 44 running at almost ground level between the stiles 34. It is raised slightly from the ground to allow the ladder to be used on uneven ground without the ladder 10 rocking on the ground tube 44.

The ground stabilisers 32 are retained in their retracted position against the force of the resilient member 46 in a similar manner to the way in which the stiles of the ladder are locked in the ladder's extended position. The support tube 40 of each ground stabiliser 32 is provided with a hole 50 in the upper most section of its circumference such that each is aligned with the axis of the respective stile 34.

A resiliently biased pin 52 extending from stile section 18 of rung 20, mates with the hole 50 preventing the resilient member 46 from forcing the ground stabiliser 32 outwards.

When the ladder is extended (FIG. 2) and the rungs (12,20) separated, the stile section 18 carrying the resiliently biased pin 52 is moved upwards and clear of the hole 50 causing the ground stabilisers 32 to extend laterally.

The invention claimed is:

1. An extendable ladder having a collapsed mode and an extended mode, the extendable ladder comprising:

a plurality of sections that are slidable relative to one another, each section of the plurality of sections including two stile sections and at least one rung extending therebetween;

a hollow elongate housing secured to respective lower ends of the two stile sections of a lowermost section of the plurality of sections;

at least one ground stabilizer mounted in the hollow elongate housing and movable between retracted and extended positions, the at least one ground stabilizer projecting laterally from the hollow elongate housing in the extended position so as to widen a footprint of the extendable ladder;

a spring urging the at least one ground stabilizer into the extended position; and a locking pin mounted to move with an upper section of the plurality of sections and retain the at least one ground stabilizer in the retracted position when the extendable ladder is in the collapsed mode, and to automatically release the at least one ground stabilizer when the ladder is moved into the extended mode, such that the at least one ground stabilizer is urged into the extended position by the spring.

2. The ladder as claimed in claim 1, wherein the upper section and the lowermost section of the extendable ladder extend telescopically.

3. The ladder as claimed in claim 2, wherein the locking pin is supported by the upper section such that when the upper section is extended relative to the lowermost section, the locking pin is pulled out of a hole in the at least one ground stabilizer so as to release the ground stabilizer.

4. The ladder as claimed in claim 1, wherein the locking pin is resiliently biased towards a hole in the at least one ground stabilizer.

5. The ladder as claimed in claim 1, wherein the upper section and the lowermost section of the extendable ladder extend telescopically and the at least one ground stabilizer includes at least two ground stabilizers, each extending laterally from opposite ends of the hollow elongate housing.

6. The ladder as claimed in claim 5, wherein the at least two ground stabilizers are biased apart by the spring, the spring being contained within the hollow elongate housing.

* * * * *